US009400120B2

(12) United States Patent
Kinugasa

(10) Patent No.: US 9,400,120 B2
(45) Date of Patent: Jul. 26, 2016

(54) STARTUP CONTROL APPARATUS OF AIR CONDITIONER

(75) Inventor: Nanae Kinugasa, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 1291 days.

(21) Appl. No.: 13/002,201

(22) PCT Filed: Jul. 8, 2009

(86) PCT No.: PCT/JP2009/003175

§ 371 (c)(1),
(2), (4) Date: Dec. 30, 2010

(87) PCT Pub. No.: WO2010/004740

PCT Pub. Date: Jan. 14, 2010

(65) Prior Publication Data

US 2011/0107781 A1 May 12, 2011

(30) Foreign Application Priority Data

Jul. 11, 2008 (JP) ..... 2008-181957

(51) Int. Cl.
*G05D 23/32* (2006.01)
*F24F 11/00* (2006.01)
*F25B 49/02* (2006.01)

(52) U.S. Cl.
CPC ..... *F24F 11/008* (2013.01); *F24F 2011/0064* (2013.01); *F25B 49/022* (2013.01);
(Continued)

(58) Field of Classification Search
CPC ..... F25B 2600/025; F25B 2600/0252; F25B 2600/0253
USPC ..... 62/228.1, 157, 126, 228.5, 231; 236/46 C; 700/276
See application file for complete search history.

(56) References Cited

U.S. PATENT DOCUMENTS 4,172,555 A * 10/1979 Levine ..... 236/46 R
4,674,027 A * 6/1987 Beckey ..... 700/14
(Continued)

FOREIGN PATENT DOCUMENTS

JP 60-99945 A 6/1985
JP 62-272046 A 11/1987
(Continued)

OTHER PUBLICATIONS

International Search Report of corresponding PCT Application No. PCT/JP2009/003175.
(Continued)

*Primary Examiner* — Marc Norman
*Assistant Examiner* — David Teitelbaum
(74) *Attorney, Agent, or Firm* — Global IP Counselors

(57) ABSTRACT

An air conditioner performs startup control in which compressor capacity is reduced as measured indoor temperature approaches a set temperature. A desired time of day is set directly or indirectly. A startup control apparatus of the air conditioner measures an inflection point occurrence time from when the air conditioner starts operation until when measured indoor temperature exhibits an inflection point. Alternatively, the startup control apparatus measures a control parameter lowering arrival time from when the air conditioner starts operation until when a control parameter transmitted to the compressor decreases to a prescribed value. A scheduled operation start time of the air conditioner is set as a time of day that is the desired time of day set moved forward by the inflection point occurrence time or the control parameter lowering arrival time. Operation of the air conditioner is started when the scheduled operation start time arrives.

11 Claims, 6 Drawing Sheets

(52) U.S. Cl.
CPC ..... *F25B2500/26* (2013.01); *F25B 2600/02* (2013.01); *F25B 2600/025* (2013.01); *F25B 2600/0252* (2013.01); *F25B 2600/0253* (2013.01); *F25B 2700/2104* (2013.01)

(56) References Cited

U.S. PATENT DOCUMENTS 4,909,041 A * 3/1990 Jones ..... 62/99
5,152,152 A * 10/1992 Brickner et al. ..... 62/126
5,197,293 A * 3/1993 Okamura et al. ... F24F 11/0009 165/263
5,410,230 A * 4/1995 Bessler et al. ..... 318/471
5,699,674 A * 12/1997 Lee et al. ..... 62/115
6,520,746 B2 * 2/2003 Yoo et al. ..... 417/44.11
2007/0227721 A1 * 10/2007 Springer et al. ..... 165/291
2008/0028780 A1 * 2/2008 Song ..... 62/228.1

FOREIGN PATENT DOCUMENTS

JP 2-133747 A 5/1990
JP 2002-310481 A 10/2002
KR 2002-0004472 A 1/2002

OTHER PUBLICATIONS

International Preliminary Report of corresponding PCT Application No. PCT/JP2009/003175.
European Search Report of corresponding EP Application No. 09 79 4188.4 dated Feb. 2, 2015.

* cited by examiner

STARTUP CONTROL APPARATUS OF AIR CONDITIONER

CROSS-REFERENCE TO RELATED APPLICATIONS

This U.S. National stage application claims priority under 35 U.S.C. §119(a) to Japanese Patent Application No. 2008-181957, filed in Japan on Jul. 11, 2008, the entire contents of which are hereby incorporated herein by reference.

TECHNICAL FIELD

The present invention relates to a startup control apparatus of an air conditioner.

BACKGROUND ART

In the past, a "startup control apparatus of an air conditioner, which starts precooling operation or preheating operation at an operation start time that is moved forward by amount of time from when the air conditioner starts operation until when a thermostat turns off" has been proposed (e.g., Japanese Unexamined Patent Application Publication No. S62-272046).

SUMMARY

Technical Problem

Incidentally, in recent years, an air conditioner has been commercialized that is equipped with an inverter and wherein capacity of a compressor decreases gradually as an indoor temperature approaches a set temperature. If a startup control apparatus like the one discussed above is adapted to such an air conditioner, then a front-loading time required becomes too long and, as a result, electric power consumption cannot be reduced sufficiently, which is a problem.

An object of the present invention is to reduce electric power consumption when an air conditioner—wherein capacity of a compressor is automatically reduced as an indoor temperature approaches a set temperature, thereby bringing the indoor temperature close to the set temperature—is made to perform front-loading operation.

Solution to Problem

A startup control apparatus of an air conditioner according to a first aspect of the present invention is a startup control apparatus of an air conditioner that performs startup control of the air conditioner, wherein capacity of a compressor is automatically reduced as an indoor temperature approaches a set temperature, thereby bringing the indoor temperature close to the set temperature, and comprises a desired time setting unit, an indoor temperature measuring unit, an inflection point occurrence time measuring unit, an air conditioning operation scheduled start time determining unit, and a startup control unit. Furthermore, the "air conditioner, wherein capacity of a compressor is automatically reduced as an indoor temperature approaches a set temperature, thereby bringing the indoor temperature close to the set temperature" herein is, for example, an air conditioner that is equipped with an inverter controlled compressor and the like. The desired time setting unit sets a desired time of day directly or indirectly. Furthermore, "sets a desired time of day indirectly" herein is, for example, to set at t hours from a certain time of day, and the like. The indoor temperature measuring unit measures the indoor temperature. The inflection point occurrence time measuring unit measures time (hereinafter called "inflection point occurrence time") from when the air conditioner starts operation until when the indoor temperature (hereinafter called a "measured indoor temperature") measured by the indoor temperature measuring unit exhibits an inflection point. The air conditioning operation scheduled start time determining unit sets as a scheduled operation start time of the air conditioner a time of day that is the desired time of day set by the desired time setting unit moved forward by the inflection point occurrence time. The startup control unit starts operation of the air conditioner when the scheduled operation start time set by the air conditioning operation scheduled start time determining unit comes.

Consequently, if the startup control apparatus of the air conditioner according to the present invention is adapted to an air conditioner wherein the capacity of the compressor is automatically reduced as the indoor temperature approaches the set temperature and the indoor temperature is thereby drawn close to the set temperature, then a front-loading time (which corresponds to the inflection point occurrence time in the present invention, and to a thermostat turn off time in the conventional example) is reduced more than is the case when the conventional art is adopted, namely, "a startup control apparatus of an air conditioner that starts precooling operation or preheating operation at an operation start time of day that is moved forward by a time (hereinafter called a 'thermostat off time') from when the air conditioner starts operation until when the thermostat turns off." Accordingly, if the startup control apparatus of the air conditioner according to the present invention is used in an air conditioner wherein the capacity of the compressor is automatically reduced as the indoor temperature approaches the set temperature and thereby the indoor temperature is drawn close to the set temperature, then the electric power consumption can be reduced more than that in the conventional art.

A startup control apparatus of an air conditioner according to a second aspect of the present invention is the startup control apparatus of the air conditioner according to the first aspect of the present invention, wherein the inflection point occurrence time measuring unit comprises a moving average value calculating and storing section (means), a slope calculating and storing section (means), and an inflection point detecting section (means). The moving average value calculating and storing section (means) calculates and stores a moving average value of the measured indoor temperature each time a prescribed time interval elapses. The slope calculating and storing section (means) calculates and stores a slope of a change in the measured indoor temperature by subtracting the second-latest moving average value of the measured indoor temperature from the latest moving average value of the measured indoor temperature. The inflection point detecting section (means detects the inflection point by comparing a positive or negative sign of the latest slope of the change with a positive or negative sign of the second-latest slope of the change.

Consequently, in the startup control apparatus of the air conditioner, the inflection point can be detected using comparatively simple logic. Accordingly, in the startup control apparatus of the air conditioner, the inflection point can be detected comparatively rapidly.

A startup control apparatus of an air conditioner according to a third aspect of the present invention is the startup control apparatus of the air conditioner according to the first or second aspects of the present invention, and further comprises an absolute difference calculating unit, and an inflection point occurrence time remeasuring command unit. When the inflection point occurs, the absolute difference calculating unit calculates an absolute difference between the set temperature and the measured indoor temperature. If the absolute difference is greater than or equal to a prescribed value, the inflection point occurrence time remeasuring command unit causes the inflection point occurrence time measuring unit to remeasure the inflection point occurrence time.

Consequently, in the startup control apparatus of the air conditioner, if the indoor temperature at the inflection point occurrence time markedly deviates from the set temperature, then the inflection point occurrence time can be corrected. Accordingly, if the startup control apparatus of the air conditioner is used, it is possible to prepare the air conditioning environment such that it is extremely close to the air conditioning environment desired by the user at the desired time of day.

A startup control apparatus of an air conditioner according to a fourth aspect of the present invention is the startup control apparatus of the air conditioner according to the first or second aspects of the present invention, and further comprises an absolute difference calculating unit, and an inflection point occurrence time remeasuring command unit. When the inflection point occurs, the absolute difference calculating unit calculates an absolute difference between the set temperature and the measured indoor temperature. If the absolute difference is greater than or equal to a prescribed value, the inflection point occurrence time remeasuring command unit adds the absolute difference to or subtracts the absolute difference from the set temperature and then causes the inflection point occurrence time measuring unit to remeasure the inflection point occurrence time. Furthermore, the inflection point occurrence time remeasuring command unit subtracts the absolute difference from the set temperature during cooling mode, and adds the absolute difference to the set temperature during heating mode.

Consequently, in the startup control apparatus of the air conditioner, if the indoor temperature at the inflection point occurrence time markedly deviates from the set temperature, then the inflection point occurrence time can be corrected. Accordingly, if the startup control apparatus of the air conditioner is used, it is possible to prepare the air conditioning environment such that it is extremely close to the air conditioning environment desired by the user at the desired time of day.

A startup control apparatus of an air conditioner according to a fifth aspect of the present invention is the startup control apparatus of the air conditioner according to the first or second aspects of the present invention, and further comprises a temperature difference calculating unit, and an inflection point occurrence time remeasuring command unit. When the inflection point occurs, the temperature difference calculating unit calculates a temperature difference by subtracting the measured indoor temperature from the set temperature. If the temperature difference is greater than or equal to a prescribed value or less than or equal to the prescribed value, the inflection point occurrence time remeasuring command unit causes the inflection point occurrence time measuring unit to remeasure the inflection point occurrence time. Furthermore, the inflection point occurrence time remeasuring command unit causes the inflection point occurrence time measuring unit to remeasure the inflection point occurrence time during the cooling mode if the temperature difference is less than or equal to the prescribed value, and to remeasure the inflection point occurrence time during the heating mode if the temperature difference is greater than or equal to the prescribed value.

Consequently, in the startup control apparatus of the air conditioner, if the indoor temperature at the inflection point occurrence time markedly deviates from the set temperature, then the inflection point occurrence time can be corrected. Accordingly, if the startup control apparatus of the air conditioner is used, it is possible to prepare the air conditioning environment such that it is extremely close to the air conditioning environment desired by the user at the desired time of day.

A startup control apparatus of an air conditioner according to a sixth aspect of the present invention is the startup control apparatus of the air conditioner according to the first or second aspects of the present invention, and further comprises a temperature difference calculating unit, and an inflection point occurrence time remeasuring command unit. When the inflection point occurs, the temperature difference calculating unit calculates a temperature difference by subtracting the measured indoor temperature from the set temperature. If the temperature difference is greater than or equal to a prescribed value or less than or equal to the prescribed value, the inflection point occurrence time remeasuring command unit adds the temperature difference to the set temperature and then causes the inflection point occurrence time measuring unit to remeasure the inflection point occurrence time. Furthermore, the inflection point occurrence time remeasuring command unit causes the inflection point occurrence time measuring unit to remeasure the inflection point occurrence time during the cooling mode if the temperature difference is less than or equal to the prescribed value, and to remeasure the inflection point occurrence time during the heating mode if the temperature difference is greater than or equal to the prescribed value.

Consequently, in the startup control apparatus of the air conditioner, if the indoor temperature at the inflection point occurrence time markedly deviates from the set temperature, then the inflection point occurrence time can be corrected. Accordingly, if the startup control apparatus of the air conditioner is used, it is possible to prepare the air conditioning environment such that it is extremely close to the air conditioning environment desired by the user at the desired time of day.

A startup control apparatus of an air conditioner according to a seventh aspect of the present invention is a startup control apparatus of an air conditioner that performs startup control of the air conditioner, wherein capacity of a compressor is automatically reduced as an indoor temperature approaches a set temperature, thereby bringing the indoor temperature close to the set temperature, and comprises a desired time setting unit, an indoor temperature measuring unit, a control parameter lowering arrival time measuring unit, an air conditioning operation scheduled start time determining unit, and a startup control unit. Furthermore, the "air conditioner, wherein capacity of a compressor is automatically reduced as an indoor temperature approaches a set temperature, thereby bringing the indoor temperature close to the set temperature" herein is, for example, an air conditioner that is equipped with an inverter controlled compressor and the like. The desired time setting unit sets a desired time of day directly or indirectly. The indoor temperature measuring unit measures the indoor temperature. The control parameter lowering arrival time measuring unit measures time (hereinafter called "control parameter lowering arrival time") from when the air conditioner starts operation until when a control parameter transmitted to the compressor decreases to a prescribed value. Furthermore, the control parameter herein is, for example, a thermostat step value (i.e., numerical information by which an operation frequency of the compressor installed in the air conditioner is reduced) and the like. The air conditioning operation scheduled start time determining unit sets as a scheduled operation start time of the air conditioner a time of day that is the desired time of day set by the desired time setting unit moved forward by the control parameter lowering arrival time. The startup control unit starts operation of the air conditioner when the scheduled operation start time set by the air conditioning operation scheduled start time determining unit comes.

Consequently, if the startup control apparatus of the air conditioner according to the present invention is adapted to an air conditioner wherein the capacity of the compressor is automatically reduced as the indoor temperature approaches the set temperature and the indoor temperature is thereby drawn close to the set temperature, then a front-loading time (which corresponds to the control parameter lowering arrival time in the present invention, and to a thermostat turn off time in the conventional example) is reduced more than is the case when the conventional art is adopted, namely, "a startup control apparatus of an air conditioner that starts precooling operation or preheating operation at an operation start time of day that is moved forward by a time (hereinafter called a 'thermostat off time') from when the air conditioner starts operation until when the thermostat turns off" Accordingly, if the startup control apparatus of the air conditioner according to the present invention is used in an air conditioner wherein the capacity of the compressor is automatically reduced as the indoor temperature approaches the set temperature and thereby the indoor temperature is drawn close to the set temperature, then the electric power consumption can be reduced more than that in the conventional art.

Advantageous Effects of Invention

If the startup control apparatus of the air conditioner according to the first aspect of the present invention is adapted to an air conditioner wherein the capacity of the compressor is automatically reduced as the indoor temperature approaches the set temperature and the indoor temperature is thereby drawn close to the set temperature, then a front-loading time (which corresponds to the inflection point occurrence time in the present invention, and to a thermostat turn off time in the conventional example) is reduced more than is the case when the conventional art is adopted, namely, "a startup control apparatus of an air conditioner that starts precooling operation or preheating operation at an operation start time of day that is moved forward by a time (hereinafter called a 'thermostat off time') from when the air conditioner starts operation until when the thermostat turns off." Accordingly, if the startup control apparatus of the air conditioner according to the present invention is used in an air conditioner wherein the capacity of the compressor is automatically reduced as the indoor temperature approaches the set temperature and thereby the indoor temperature is drawn close to the set temperature, then the electric power consumption can be reduced more than that in the conventional art.

In the startup control apparatus of the air conditioner according to the second aspect of the present invention, the inflection point can be detected using comparatively simple logic. Accordingly, in the startup control apparatus of the air conditioner, the inflection point can be detected comparatively rapidly.

In the startup control apparatus of the air conditioner according to the third aspect of the present invention, if the indoor temperature at the inflection point occurrence time markedly deviates from the set temperature, then the inflection point occurrence time can be corrected. Accordingly, if the startup control apparatus of the air conditioner is used, it is possible to prepare the air conditioning environment such that it is extremely close to the air conditioning environment desired by the user at the desired time of day.

In the startup control apparatus of the air conditioner according to the fourth aspect of the present invention, if the indoor temperature at the inflection point occurrence time markedly deviates from the set temperature, then the inflection point occurrence time can be corrected. Accordingly, if the startup control apparatus of the air conditioner is used, it is possible to prepare the air conditioning environment such that it is extremely close to the air conditioning environment desired by the user at the desired time of day.

In the startup control apparatus of the air conditioner according to the fifth aspect of the present invention, if the indoor temperature at the inflection point occurrence time markedly deviates from the set temperature, then the inflection point occurrence time can be corrected. Accordingly, if the startup control apparatus of the air conditioner is used, it is possible to prepare the air conditioning environment such that it is extremely close to the air conditioning environment desired by the user at the desired time of day.

In the startup control apparatus of the air conditioner according to the sixth aspect of the present invention, if the indoor temperature at the inflection point occurrence time markedly deviates from the set temperature, then the inflection point occurrence time can be corrected. Accordingly, if the startup control apparatus of the air conditioner is used, it is possible to prepare the air conditioning environment such that it is extremely close to the air conditioning environment desired by the user at the desired time of day.

If the startup control apparatus of the air conditioner according to the seventh aspect of the present invention is adapted to an air conditioner wherein the capacity of the compressor is automatically reduced as the indoor temperature approaches the set temperature and the indoor temperature is thereby drawn close to the set temperature, then a front-loading time (which corresponds to the control parameter lowering arrival time in the present invention, and to a thermostat turn off time in the conventional example) is reduced more than is the case when the conventional art is adopted, namely, "a startup control apparatus of an air conditioner that starts precooling operation or preheating operation at an operation start time of day that is moved forward by a time (hereinafter called a 'thermostat off time') from when the air conditioner starts operation until when the thermostat turns off." Accordingly, if the startup control apparatus of the air conditioner according to the present invention is used in an air conditioner wherein the capacity of the compressor is automatically reduced as the indoor temperature approaches the set temperature and thereby the indoor temperature is drawn close to the set temperature, then the electric power consumption can be reduced more than that in the conventional art.

DESCRIPTION OF EMBODIMENTS

Figure 1:
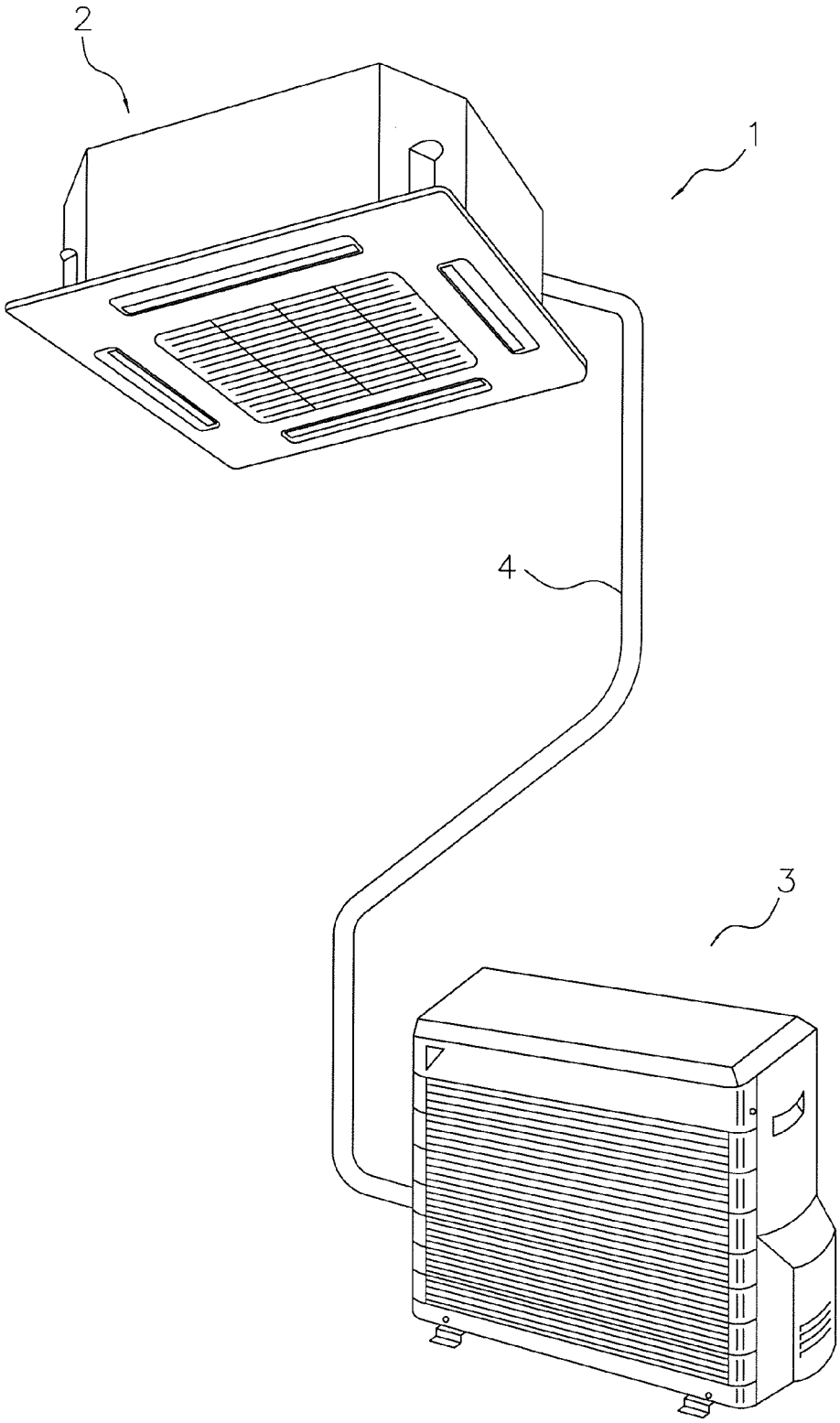
FIG. 1 is an external view of an air conditioner equipped with a heat exchanger according to one embodiment of the present invention.
Figure 2:
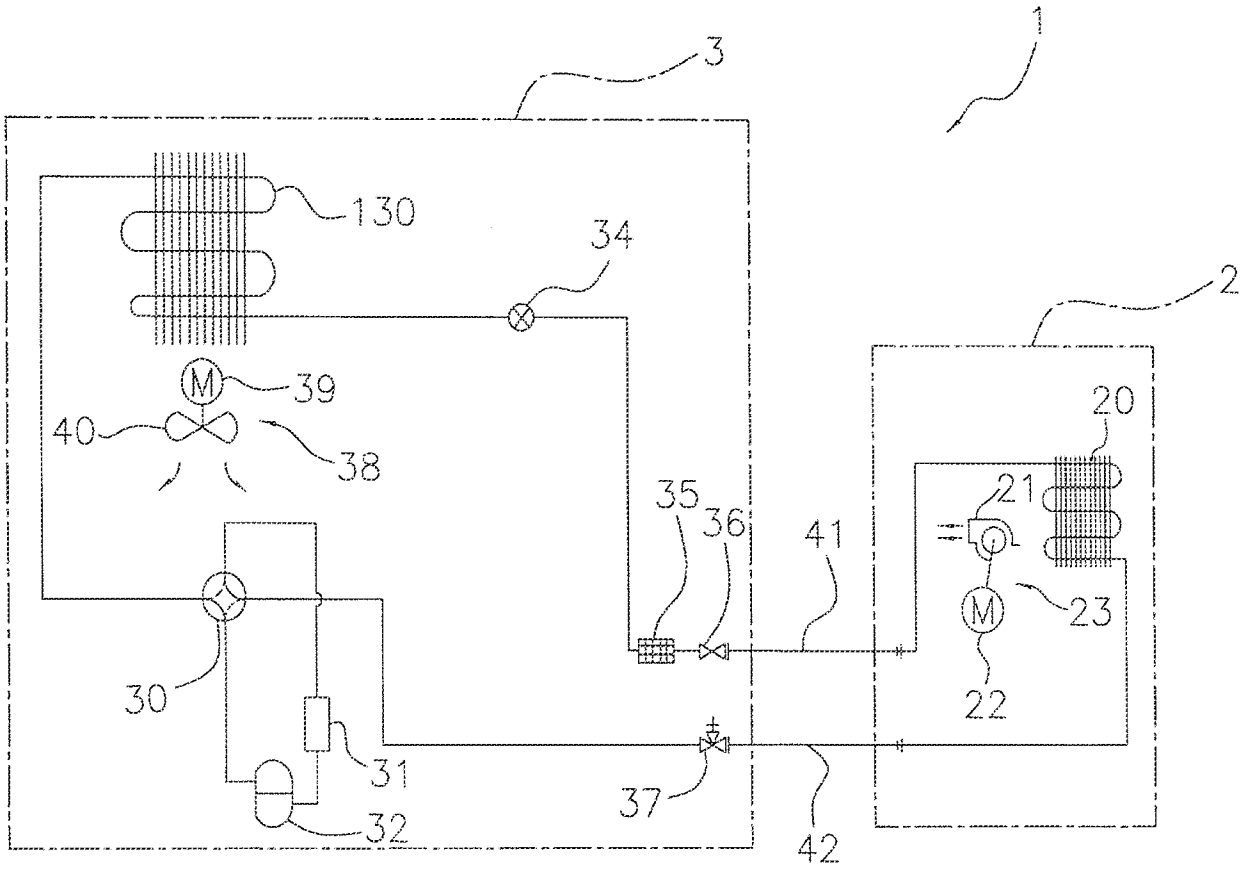
FIG. 2 is a schematic drawing of a refrigerant circuit of the air conditioner.

As shown in FIG. 1, an air conditioner 1 according to an embodiment of the present invention is a separate type air conditioner and principally comprises a ceiling embedded type indoor unit 2, which is embedded in the ceiling of an indoor space, and an outdoor unit 3, which is installed in an outdoor space. Furthermore, an indoor heat exchanger is housed in the indoor unit 2 and an outdoor heat exchanger is housed in the outdoor unit 3; furthermore, a refrigerant circuit is configured by connecting these heat exchangers using a refrigerant pipe 4. Furthermore, as shown in FIG. 2, the refrigerant circuit principally comprises an indoor heat exchanger 20, an accumulator 31, a compressor 32, a four-way switching valve 30, an outdoor heat exchanger 130, and an electric expansion valve 34.

The text below explains the indoor unit 2 and the outdoor unit 3 in detail.

<Indoor Unit>

Figure 3:
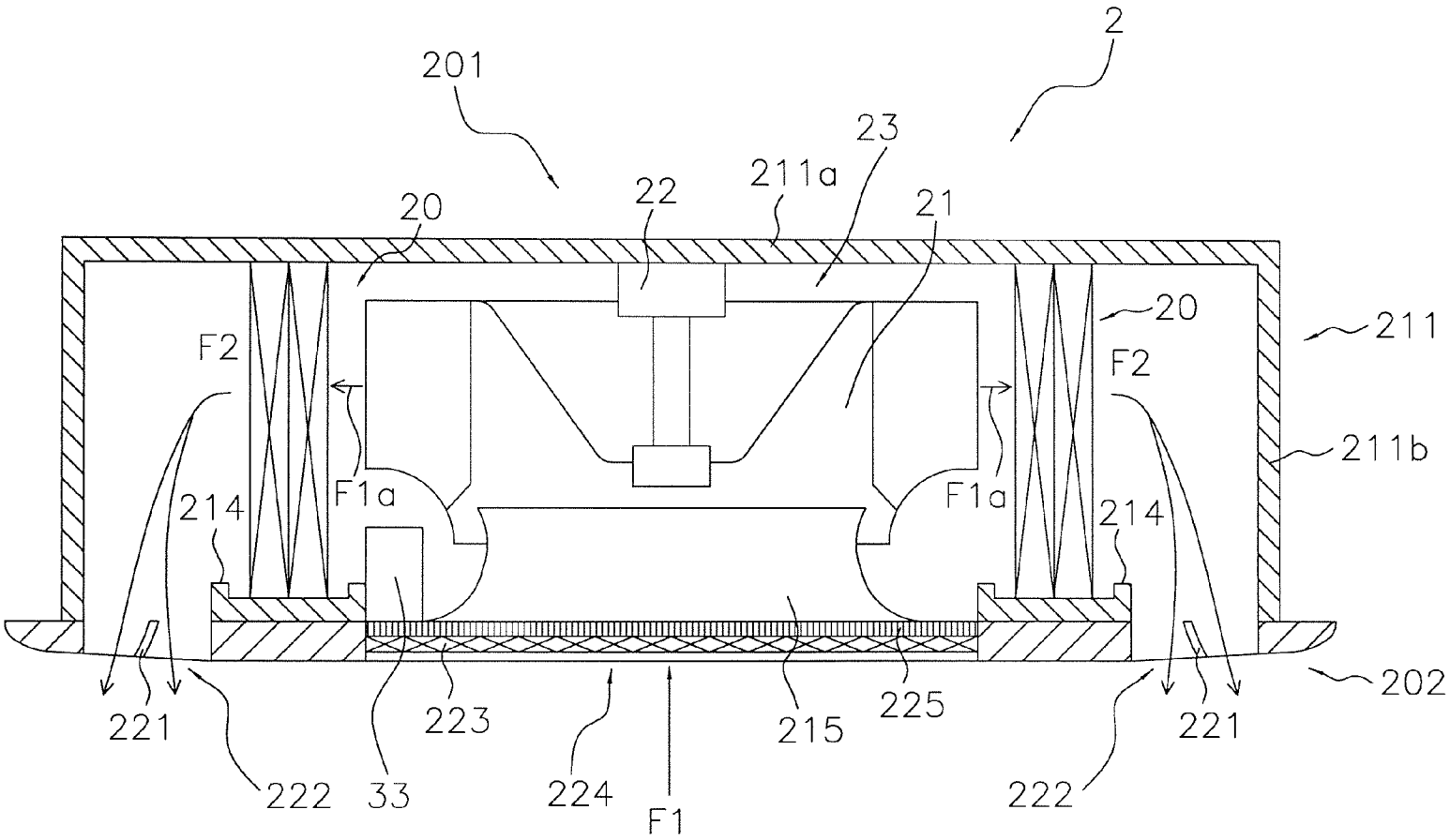
FIG. 3 is a side cross sectional view of an indoor unit of the air conditioner.

As shown in FIG. 3, the indoor unit 2 principally comprises a main body 201, which is embedded in a ceiling when installed, and a face panel 202, which is exposed to the living space when installed.

Figure 4:
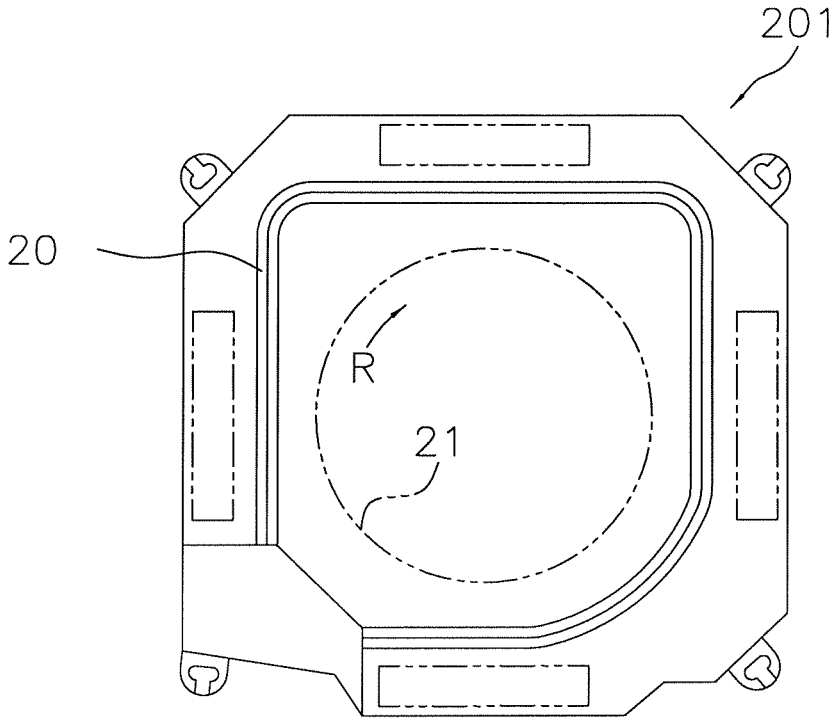
FIG. 4 is a bottom view of a main body unit of the indoor unit of the air conditioner.

As shown in FIG. 3 and FIG. 4, the main body 201 comprises a main body casing 211, a centrifugal fan 23, the indoor heat exchanger 20, a drain pan 214, an electrical equipment box 33, a bell mouth 215, and an inlet temperature sensor (not shown).

As shown in FIG. 3, the main body casing 211 is a box, the lower surface of which is open, and comprises a top plate 211*a* and a side plate 211*b*, which extends downward from the peripheral edges of the top plate 211*a*. Various constituent parts are housed inside the main body casing 211.

In the present embodiment, the centrifugal fan 23 is a turbofan and comprises: a fan motor 22, which is provided in the center of the top plate 211*a* of the main body casing 211; and an impeller 21, which is coupled to and rotatably driven by the fan motor 22. The centrifugal fan 23 can suck air inside a living space (hereinafter called "indoor air") into the interior of the impeller 21 and can blow air out to the outer circumferential side of the impeller 21.

As shown in FIG. 4, in the present embodiment, the indoor heat exchanger 20 is a cross fin tube type heat exchanger that is bent such that it surrounds the outer circumference of the centrifugal fan 23. The indoor heat exchanger 20 can function as an evaporator of the refrigerant flowing internally during cooling operation and as a condenser of the refrigerant flowing internally during heating operation. Furthermore, the indoor heat exchanger 20 can, during cooling operation, cool the indoor air that was sucked through the bell mouth 215 into the main body casing 211 and blown out to the outer circumferential side of the impeller 21 of the centrifugal fan 23, and can, during heating operation, heat that indoor air. Furthermore, the details of the indoor heat exchanger 20 are discussed later.

The drain pan 214 is disposed on the lower side of the indoor heat exchanger 20 and receives the drain water produced by the condensation of moisture in the indoor air when the indoor air is cooled in the indoor heat exchanger 20.

Figure 6:
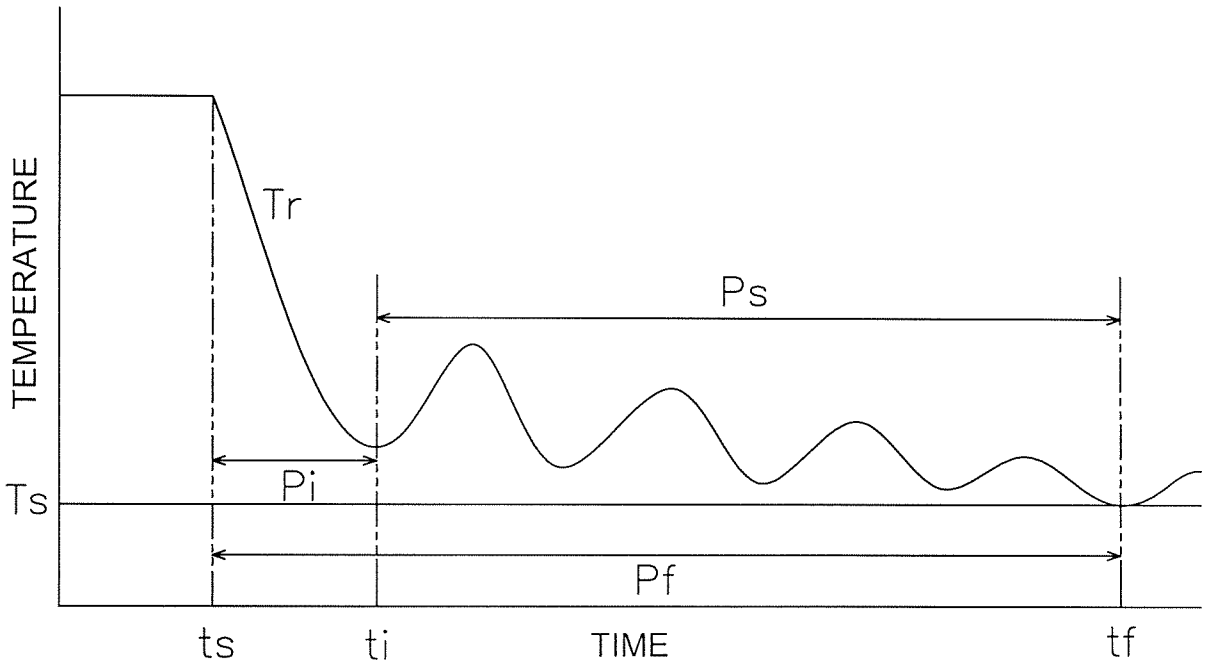
FIG. 6 is a graph for explaining the startup control of the air conditioner according to the present invention.

As shown in FIG. 3, the electrical equipment box 33 is installed in an edge of the bell mouth 215. The electrical equipment box 33 houses as the electrical equipment a control circuit board (not shown). Furthermore, electronic devices, such as a microcomputer and an EEPROM and the like, are incorporated in the control circuit board. In addition, the control circuit board is connected to the centrifugal fan 23, the inlet temperature sensor, and the like disposed in the indoor unit 2 and, based on a control signal that reflects various control parameters, controls the rotational speed of the centrifugal fan 23, the angle of louvers 221, and the like. In addition, the control circuit board is also connected to and communicates with a control circuit board of the outdoor unit 3 (not shown) and thereby receives various request signals from a remote controller (not shown) and transmits to the control circuit board of the outdoor unit 3, for example, a signal (hereinafter called a "thermostat step signal") for adjusting the capacity of the compressor 32, a signal for adjusting the degree of opening of the electric expansion valve 34, and a signal for switching the four-way switching valve 30. Furthermore, in the present embodiment, as shown in FIG. 6, the control circuit board generates a thermostat step signal such that the capacity of the compressor 32 is automatically reduced as an inlet temperature Tr approaches a set temperature Ts, thereby bringing the inlet temperature Tr close to the set temperature Ts. In addition, in the present embodiment, a startup control program is written into the EEPROM of the control circuit board. Furthermore, in the present embodiment, the microcomputer performs startup control in accordance with the startup control program. Startup control is discussed in detail later.

As shown in FIG. 3, the face panel 202 is a substantially square plate shaped body and principally comprises an inlet port 224, which sucks in the indoor air into the main body casing 211 at substantially the center thereof, and a plurality of outlet ports 222 (in the present embodiment, four outlet ports 222), which blow the air-conditioned air from the interior of the main body casing 211 out to the living space. The louvers 221 for regulating the wind direction are provided in the outlet ports 222. The inlet port 224 is provided with an inlet grill 223 and a prefilter 225 for eliminating comparatively large dust in the indoor air sucked in from the inlet port 224.

Furthermore, when the impeller 21 is rotated by the fan motor 22, the indoor air is sucked into the inlet port 224 of the indoor unit 2 as indicated by an arrow F1 in FIG. 3. The sucked indoor air passes through the bell mouth 215 of the main body 201, arrives at the impeller 21, and is then blown out to the outer circumferential side of the impeller 21 (refer to arrows F1*a* in FIG. 3). The heat of the indoor air blown out to the outer circumferential side of the impeller 21 is exchanged by the indoor heat exchanger 20, which is disposed on the outer circumferential side of the impeller 21, and is then blown out from the outlet ports 222 into the indoor space (refer to arrows F2 in FIG. 3). In addition, each of the louvers 221 is designed such that it can be moved reciprocatively in the vertical directions by a compact motor specialized in driving louvers (not shown).

<Outdoor Unit>

The outdoor unit 3 principally houses: the compressor 32; the four-way switching valve 30, which is connected to the discharge side of the compressor 32; the accumulator 31, which is connected to the inlet side of the compressor 32; the outdoor heat exchanger 130, which is connected to the four-way switching valve 30; and the electric expansion valve 34, which is connected to the outdoor heat exchanger 130. The compressor 32 is an inverter controlled compressor whose capacity is controlled by adjusting the operation frequency based on the thermostat step signal transmitted from the electrical equipment box 33 of the indoor unit 2. The electric expansion valve 34 is connected to a pipe 41 via a filter 35 and a liquid shutoff valve 36, and is connected to one end of the indoor heat exchanger 20 via this pipe 41. In addition, the four-way switching valve 30 is connected to a pipe 42 via a gas shutoff valve 37, and is connected to the other end of the indoor heat exchanger 20 via this pipe 42. Furthermore, the pipes 41, 42 correspond to the refrigerant pipe 4 in FIG. 1. In addition, the outdoor unit 3 comprises a propeller fan 38 for externally discharging the air after its heat has been exchanged by the outdoor heat exchanger 130. In the propeller fan 38, a fan motor 39 rotationally drives a propeller fan rotor 40.

<Startup Control>

Figure 5:
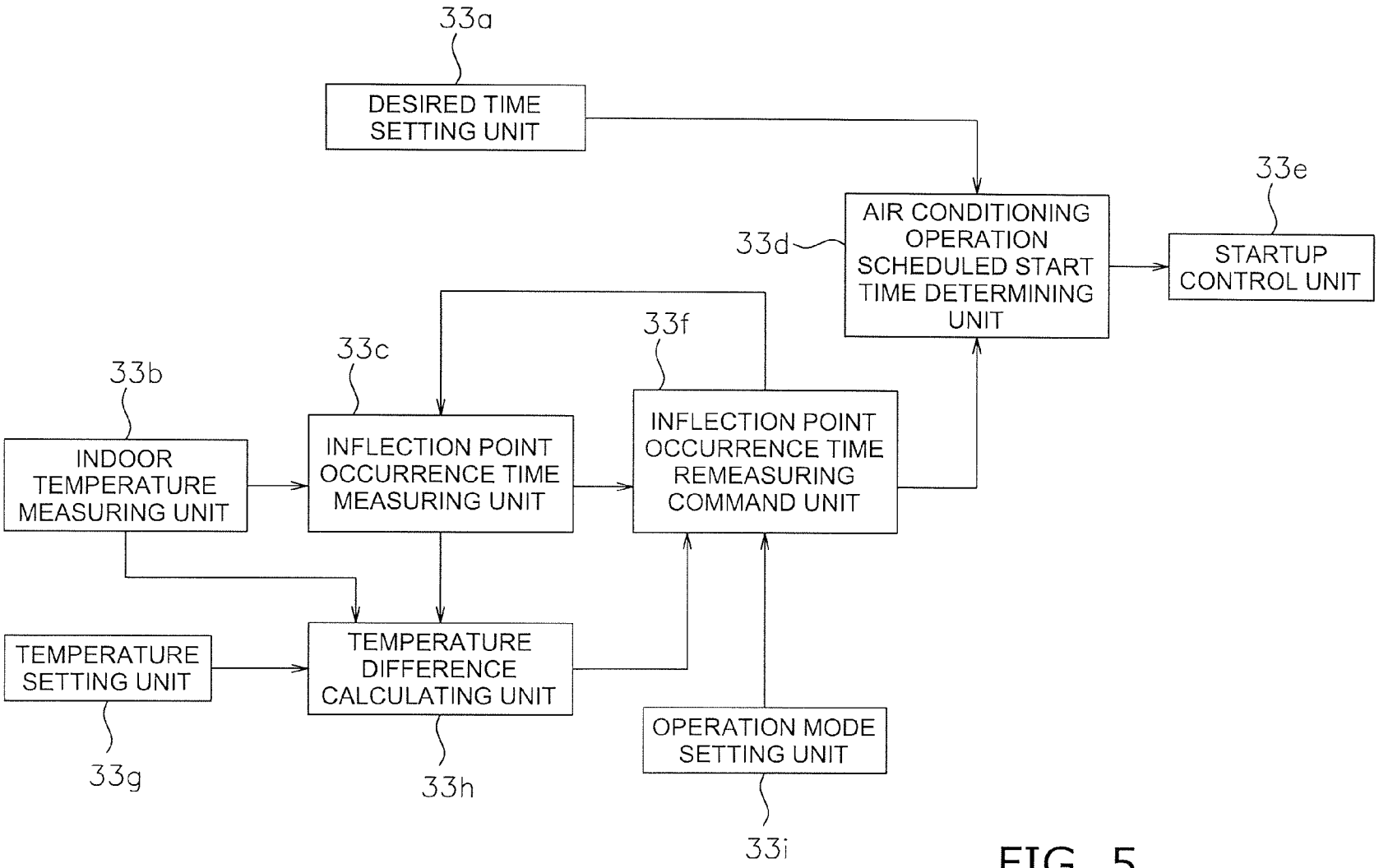
FIG. 5 is a functional block diagram that depicts startup control of the air conditioner according to the present invention.

FIG. 5 is a control block diagram of startup control. The text below explains startup control according to the embodiment of the present invention, referring to the control block diagram in FIG. 5.

When the power supply to the air conditioner 1 is turned on, an indoor temperature measuring unit 33*b* starts measurement of the inlet temperature Tr (refer to FIG. 6) using the inlet temperature sensor, and every time a prescribed time elapses the measurement value of the inlet temperature Tr is transmitted to an inflection point occurrence time measuring unit 33*c* and a temperature difference calculating unit 33*h*.

A temperature setting unit 33*g* is provided to enable a user to set an outlet temperature of the air conditioner and transmits the temperature information set by the user to the temperature difference calculating unit 33*h*.

The inflection point occurrence time measuring unit 33*c* starts the measurement of the time since a time is (refer to FIG. 6) when the power supply to the air conditioner 1 was turned on, calculates a four-point simple moving average of the inlet temperature Tr every time a measurement value of the inlet temperature Tr is transmitted, and writes the four-point simple moving average of the inlet temperature Tr into a memory unit of the microcomputer. In addition, the inflection point occurrence time measuring unit 33*c* calculates the slope value of the inlet temperature Tr by subtracting the second-latest four-point simple moving average from the latest four-point simple moving average, and writes the slope value of the inlet temperature Tr into the memory unit of the microcomputer. Furthermore, during cooling mode, if the latest slope value is zero or a positive value and the second-latest slope value is a negative value, then the inflection point occurrence time measuring unit 33*c* determines that an inflection point has occurred, reads an elapsed time Pi (refer to FIG. 6) at the determination time ti (i.e., the time when the inflection point has occurred; refer to FIG. 6), transmits the elapsed time Pi to an inflection point occurrence time remeasuring command unit 33*f*, and transmits an inflection point occurrence notification signal to the temperature difference calculating unit 33*h*. In addition, during heating mode, if the latest slope value is zero or a negative value and the second-latest slope value is a positive value, then the inflection point occurrence time measuring unit 33*c* determines that an inflection point has occurred, reads the elapsed time Pi at the determination time ti, transmits the elapsed time Pi and the measurement value of the inlet temperature Tr at the determination time ti to the inflection point occurrence time remeasuring command unit 33*f*, and transmits the inflection point occurrence notification signal to the temperature difference calculating unit 33*h*.

When the inflection point occurrence notification signal is transmitted from the inflection point occurrence time measuring unit 33*c*, the temperature difference calculating unit 33*h* calculates a temperature difference value by subtracting the measurement value of the inlet temperature Tr transmitted from the indoor temperature measuring unit 33*b* at that time from the set temperature Ts (refer to FIG. 6), and then transmits the temperature difference value to the inflection point occurrence time remeasuring command unit 33*f*.

An operation mode setting unit 33*i* is provided to enable the user to set an operation mode (e.g., a cooling operation mode, a heating operation mode, or a dehumidifying operation mode) of the air conditioner and transmits the operation mode information set by the user to the inflection point occurrence time remeasuring command unit 33*f*.

The inflection point occurrence time remeasuring command unit 33*f* transmits: (i) the elapsed time Pi, which was transmitted from the inflection point occurrence time measuring unit 33*c*, to an air conditioning operation scheduled start time determining unit 33*d* if the operation mode information transmitted from the operation mode setting unit 33*i* is cooling operation mode information and the temperature difference value transmitted from the temperature difference calculating unit 33*h* is greater than a prescribed value, (ii) a remeasuring command signal to the inflection point occurrence time measuring unit 33*c* if the operation mode information transmitted from the operation mode setting unit 33*i* is cooling operation mode information and the temperature difference value transmitted from the temperature difference calculating unit 33*h* is less than or equal to the prescribed value, (iii) the elapsed time Pi, which was transmitted from the inflection point occurrence time measuring unit 33*c*, to the air conditioning operation scheduled start time determining unit 33*d* if the operation mode information transmitted from the operation mode setting unit 33*i* is heating operation mode information and the temperature difference value transmitted from the temperature difference calculating unit 33*h* is less than the prescribed value, and (iv) a remeasuring command signal to the inflection point occurrence time measuring unit 33*c* if the operation mode information transmitted from the operation mode setting unit 33*i* is heating operation mode information and the temperature difference value transmitted from the temperature difference calculating unit 33*h* is greater than or equal to the prescribed value. Furthermore, if the inflection point occurrence time measuring unit 33*c* receives the remeasuring command signal, the inflection point occurrence time measuring unit 33*c* measures the time from when the power supply to the air conditioner 1 was turned on until the next inflection point occurrence time ti.

A desired time setting unit 33*a* is provided to enable the user to set a time of day when the desired air conditioning environment can be enjoyed, and transmits the time of day information set by the user to the air conditioning operation scheduled start time determining unit 33*d*.

The air conditioning operation scheduled start time determining unit 33*d* sets as the next scheduled operation start time the time of day that is calculated by subtracting the elapsed time from the desired time of day set in the desired time setting unit 33*a*.

A startup control unit 33*e* starts the operation of the air conditioner when the scheduled operation start time set by the air conditioning operation scheduled start time determining unit arrives.

<Characteristics of the Air Conditioner>

(1)

In the air conditioner 1 according to the present embodiment, the thermostat step signal is generated such that the capacity of the compressor 32 is automatically reduced as the inlet temperature Tr approaches the set temperature Ts, thereby bringing the inlet temperature Tr close to the set temperature Ts. Furthermore, in the air conditioner 1, the time (hereinafter called the "inflection point occurrence time") from the time is when the power supply is turned on until the time ti when the inlet temperature Tr exhibits an inflection point, is measured and the time of day calculated by subtracting the inflection point occurrence time from the desired time of day set by the user is set as the next scheduled operation start time. Consequently, compared with the conventional air conditioner wherein the time of day calculated by subtracting a time Pf (refer to FIG. 6) from the operation start time ts until a thermostat turn off time tf (refer to FIG. 6) serves as the next scheduled operation start time, the time spent on the precooling operation or the preheating operation is shortened by the time Ps (refer to FIG. 6). Accordingly, the air conditioner 1 according to the present embodiment can reduce electric power consumption more than the conventional air conditioner with precooling and preheating functions.

(2)

The inflection point occurrence time remeasuring command unit is provided to the air conditioner 1 according to the present embodiment. Consequently, in the air conditioner 1, if the inlet temperature Tr at the inflection point occurrence time ti markedly deviates from the set temperature Ts, then the inflection point occurrence time ti can be corrected. Accordingly, in the air conditioner 1, it is possible to prepare the air conditioning environment such that it is extremely close to the air conditioning environment desired by the user at the desired time of day set by the user.

Modified Examples

A

In the above embodiment, a separate type air conditioner is used as the air conditioner 1; however, the air conditioner may be a multi-type air conditioner or may be an integrated floor installed type air conditioner.

B

Although not specifically mentioned in the above embodiment, the desired time setting unit 33*a* may be designed such that the desired time of day is input directly, or, for example, such that the desired time of day is indirectly input as "x hours later."

C

In the air conditioner 1 according to the above embodiment, the time (hereinafter called the "inflection point occurrence time") from the time ts when the power supply is turned on until the time ti when the inlet temperature Tr exhibits an inflection point, is measured, and the time of day calculated by subtracting the inflection point occurrence time from the desired time of day set by the user is set as the next scheduled operation start time; however, the air conditioner may be designed such that what is measured is the time (hereinafter called a "thermostat lowering time") from the time ts when the power supply is turned on until the time when the thermostat step signal drops to a prescribed value, and the time of day calculated by subtracting the thermostat lowering time from the desired time of day is set as the next scheduled operation start time.

D

In the air conditioner 1 according to the above embodiment, the inflection point occurrence time remeasuring command unit 33*f* transmits a remeasuring command signal to the inflection point occurrence time measuring unit 33*c* if the operation mode information transmitted from the operation mode setting unit 33*i* is cooling operation mode information and the temperature difference value transmitted from the temperature difference calculating unit 33*h* is less than or equal to the prescribed value, and transmits a remeasuring command signal to the inflection point occurrence time measuring unit 33*c* if the operation mode information transmitted from the operation mode setting unit 33*i* is heating operation mode information and the temperature difference value transmitted from the temperature difference calculating unit 33*h* is greater than or equal to the prescribed value; however, the inflection point occurrence time remeasuring command unit 33*f* may, for example, transmit to the temperature setting unit 33*g* a value (hereinafter called a "compensated set temperature") calculated by adding the temperature difference value (i.e., a negative value) to the set temperature and may transmit the remeasuring command signal to the inflection point occurrence time measuring unit 33*c* if the operation mode information transmitted from the operation mode setting unit 33*i* is cooling operation mode information and the temperature difference value transmitted from the temperature difference calculating unit 33*h* is less than or equal to a prescribed value, or the inflection point occurrence time remeasuring command unit 33*f* may transmit to the temperature setting unit 33*g* a value (i.e., a compensated set temperature) calculated by adding the temperature difference value (i.e., a positive value) to the set temperature and may transmit the remeasuring command signal to the inflection point occurrence time measuring unit 33*c* if the operation mode information transmitted from the operation mode setting unit 33*i* is heating operation mode information and the temperature difference value transmitted from the temperature difference calculating unit 33*h* is greater than or equal to the prescribed value. Furthermore, in such a case, when the compensated set temperature value is transmitted from the inflection point occurrence time remeasuring command unit 33*f*, the temperature setting unit 33*g* overwrites the set temperature value in effect up to that point with the compensated set temperature value.

E

In the air conditioner 1 according to the above embodiment, when the inflection point occurrence notification signal is transmitted from the inflection point occurrence time measuring unit 33*c*, the temperature difference calculating unit 33*h* calculates the temperature difference value by subtracting from the set temperature Ts the measurement value of the inlet temperature Tr transmitted from the indoor temperature measuring unit 33*b* at that time, and then transmits that temperature difference value to the inflection point occurrence time remeasuring command unit 33*f*; however, the temperature difference calculating unit 33*h* may, for example, calculate the absolute difference between the set temperature Ts and the measurement value of the inlet temperature Tr transmitted from the indoor temperature measuring unit 33*b* at that time, and then transmit that absolute difference to the inflection point occurrence time remeasuring command unit 33*f*. In such a case, the operation mode information is not needed in the inflection point occurrence time remeasuring command unit 33*f*, which, if the absolute difference transmitted from the temperature difference calculating unit 33*h* is greater than the prescribed value, transmits the remeasuring command signal to the inflection point occurrence time measuring unit 33*c* and, if the absolute difference transmitted from the temperature difference calculating unit 33*h* is less than or equal to the prescribed value, transmits the elapsed time Pi transmitted from the inflection point occurrence time measuring unit 33*c* to the air conditioning operation scheduled start time determining unit 33*d*.

In addition, in the case wherein the set temperature is modified as in the modified example (D), the operation mode information is needed in the inflection point occurrence time remeasuring command unit 33*f*, which, if the operation mode information is cooling operation mode information and the absolute difference transmitted from the temperature difference calculating unit 33*h* is greater than the prescribed value, transmits to the temperature setting unit 33*g* the value (hereinafter called a "compensated set temperature value") calculated by subtracting the absolute difference from the set temperature, and transmits the remeasuring command signal to the inflection point occurrence time measuring unit 33*c*, and which, if the operation mode information is heating operation mode information and the absolute difference transmitted from the temperature difference calculating unit 33*h* is greater than the prescribed value, transmits to the temperature setting unit 33*g* the value (hereinafter called the "compensated set temperature value") calculated by adding the absolute difference to the set temperature, and transmits the remeasuring command signal to the inflection point occurrence time measuring unit 33*c*. Furthermore, in such a case, too, when the compensated set temperature value is transmitted from the inflection point occurrence time remeasuring command unit 33*f*, the temperature setting unit 33*g* overwrites the set temperature value in effect up to that point with the compensated set temperature value.

INDUSTRIAL APPLICABILITY

A startup control apparatus of an air conditioner according to the present invention can reduce electric power consumption of the air conditioner more than a conventional startup control apparatus of an air conditioner, and this capability greatly contributes to the air conditioner's conservation of electric power.

What is claimed is:

1. A startup control apparatus of an air conditioner that performs startup control of the air conditioner in which capacity of a compressor is automatically reduced as an indoor temperature approaches a set temperature to bring the indoor temperature close to the set temperature, the startup control apparatus comprising:

a desired time setting unit configured to set a desired time of day directly or indirectly;

an indoor temperature measuring unit configured to measure the indoor temperature;

an inflection point occurrence time measuring unit configured to measure an inflection point occurrence time, which is a time from when the air conditioner starts operation until when a measured indoor temperature measured by the indoor temperature measuring unit exhibits an inflection point, the inflection point being a first point in which a sign of a slope value of the indoor temperature changes by automatically and gradually reducing the capacity of the compressor in the startup control of the air conditioner as the indoor temperature approaches the set temperature to bring the indoor temperature close to the set temperature;

an air conditioning operation scheduled start time determining unit configured to set as a scheduled operation start time of the air conditioner a time of day that is the desired time of day set by the desired time setting unit moved forward by the inflection point occurrence time; and a startup control unit configured to start a subsequent start operation of the air conditioner when the scheduled operation start time set by the air conditioning operation scheduled start time determining unit arrives.

2. The startup control apparatus of the air conditioner according to claim 1, wherein the inflection point occurrence time measuring unit includes a moving average value calculating and storing section configured to calculate and store a moving average value of the measured indoor temperature each time a prescribed time interval elapses;

a slope calculating and storing section configured to calculate and store a slope of a change in the measured indoor temperature by subtracting a second-latest moving average value of the measured indoor temperature from a latest moving average value of the measured indoor temperature; and an inflection point detecting section configured to detect the inflection point by comparing a positive or negative sign of a latest slope of the change with a positive or negative sign of a second-latest slope of the change.

3. The startup control apparatus of the air conditioner according to claim 1, further comprising:

an absolute difference calculating unit configured to calculate an absolute difference between the set temperature and the measured indoor temperature when the inflection point is exhibited; and an inflection point occurrence time remeasuring command unit configured to cause the inflection point occurrence time measuring unit to remeasure the inflection point occurrence time if the absolute difference is greater than or equal to a prescribed value.

4. The startup control apparatus of the air conditioner according to claim 1, further comprising:

an absolute difference calculating unit configured to calculate an absolute difference between the set temperature and the measured indoor temperature when the inflection point is exhibited; and an inflection point occurrence time remeasuring command unit configured to add the absolute difference to or subtract the absolute difference from the set temperature and then cause the inflection point occurrence time measuring unit to remeasure the inflection point occurrence time if the absolute difference is greater than or equal to a prescribed value.

5. The startup control apparatus of the air conditioner according to claim 1, further comprising:

a temperature difference calculating unit configured to calculate a temperature difference by subtracting the measured indoor temperature from the set temperature when the inflection point is exhibited; and an inflection point occurrence time remeasuring command unit configured to cause the inflection point occurrence time measuring unit to remeasure the inflection point occurrence time if the temperature difference is greater than or equal to a prescribed value or less than or equal to the prescribed value.

6. The startup control apparatus of the air conditioner according to claim 1, further comprising:

a temperature difference calculating unit configured to calculate a temperature difference by subtracting the measured indoor temperature from the set temperature when the inflection point is exhibited; and an inflection point occurrence time remeasuring command unit configured to add the temperature difference to the set temperature and then cause the inflection point occurrence time measuring unit to remeasure the inflection point occurrence time if the temperature difference is greater than or equal to a prescribed value or less than or equal to the prescribed value.

7. A startup control apparatus of an air conditioner that performs startup control of the air in which capacity of a compressor is automatically reduced as an indoor temperature approaches a set temperature to bring the indoor temperature close to the set temperature, the startup control apparatus comprising:

a desired time setting unit configured to set a desired time of day directly or indirectly;

an indoor temperature measuring unit configured to measure the indoor temperature;

a control parameter lowering arrival time measuring unit configured to measure a control parameter lowering arrival time, the control parameter lowering arrival time being a time from when the air conditioner starts operation until when a control parameter transmitted to the compressor decreases to a prescribed value by automatically and gradually reducing the capacity of the compressor in the startup control of the air conditioner as the indoor temperature approaches the set temperature to bring the indoor temperature close to the set temperature, the control parameter being numerical information by which an operation frequency of the compressor is reduced:

an air conditioning operation scheduled start time determining unit configured to set as a scheduled operation start time of the air conditioner a time of day that is the desired time of day set by the desired time setting unit moved forward by the control parameter lowering arrival time; and a startup control unit configured to start a subsequent start operation of the air conditioner when the scheduled operation start time set by the air conditioning operation scheduled start time determining unit arrives.

8. The startup control apparatus of the air conditioner according to claim 2, further comprising:

an absolute difference calculating unit configured to calculate an absolute difference between the set temperature and the measured indoor temperature when the inflection point is exhibited; and an inflection point occurrence time remeasuring command unit configured to cause the inflection point occurrence time measuring unit to remeasure the inflection point occurrence time if the absolute difference is greater than or equal to a prescribed value.

9. The startup control apparatus of the air conditioner according to claim 2, further comprising:

an absolute difference calculating unit configured to calculate an absolute difference between the net temperature and the measured indoor temperature when the inflection point is exhibited; and an inflection point occurrence time remeasuring command unit configured to add the absolute difference to or subtract the absolute difference from the set temperature and then cause the inflection point occurrence time measuring unit to remeasure the inflection point occurrence time if the absolute difference is greater than or equal to a prescribed value.

10. The startup control apparatus of the air conditioner according to claim 2, further comprising:

a temperature difference calculating unit configured to calculate a temperature difference by subtracting the measured indoor temperature from the set temperature when t inflection point is exhibited; and an inflection point occurrence time remeasuring command unit configured to cause the inflection point occurrence time measuring unit to remeasure the inflection point occurrence time if the temperature difference is greater than or equal to a prescribed value or less than or equal to the prescribed value.

11. The startup control apparatus of the air conditioner according to claim 2, further comprising:

a temperature difference calculating unit configured to calculate a temperature difference by subtracting the measured indoor temperature from the set temperature when the inflection point is exhibited; and an inflection point occurrence time remeasuring command unit configured to add the temperature difference to the set temperature and then cause the inflection point occurrence time measuring unit to remeasure the inflection point occurrence time if the temperature difference is greater than or equal to a prescribed value or less than or equal to the prescribed value.

* * * * *